US005978200A

United States Patent [19]

Konma et al.

[11] Patent Number: 5,978,200

[45] **Date of Patent: *Nov. 2, 1999**

[54] HIGH-VOLTAGE CIRCUIT BREAKER WITH ARC GAS-BLAST

[75] Inventors: Naohiro Konma, Shama-machi; Katsuo Tanaka, Kozuka-machi, both of Japan

[73] Assignees: Schneider Electric SA, France; Nissin Electric Company, Limited, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/836,057

[22] PCT Filed: Oct. 31, 1995

[86] PCT No.: PCT/FR95/01434

§ 371 Date: Apr. 29, 1997

§ 102(e) Date: Apr. 29, 1997

[87] PCT Pub. No.: WO96/13844

PCT Pub. Date: May 9, 1996

[30] Foreign Application Priority Data

Oct. 31, 1994 [JP] Japan ..... 6/267367

[51] Int. Cl.[6] ..... H01H 33/90

[52] U.S. Cl. ..... 361/123; 218/59; 218/157

[58] Field of Search ..... 361/2, 14, 115, 361/116, 123; 218/13, 15, 34, 51–53, 57, 58, 59, 60, 76, 81, 85, 77, 89, 90, 99, 103, 105, 106, 116, 151, 157, 108

[56] References Cited

U.S. PATENT DOCUMENTS

| | | | |
|---|---|---|---|
| 4,236,053 | 11/1980 | Sasaki et al. | 200/144 R |
| 4,342,890 | 8/1982 | Grafi | 200/148 A |
| 4,516,006 | 5/1985 | Kobayashi et al. | 218/57 |

FOREIGN PATENT DOCUMENTS

| | | | |
|---|---|---|---|
| 0075668 | 4/1983 | European Pat. Off. | H01H 33/915 |
| 3009504 | 6/1981 | Germany | H01H 33/91 |

*Primary Examiner*—Ronald W. Leja
*Attorney, Agent, or Firm*—Parkhurst & Wendel, L.L.P.

[57] ABSTRACT

The high-voltage circuit breaker with gas insulation is equipped with a device for gas-blast and blowout of the arc generated between the stationary arcing contact and the movable arcing contact when the current is interrupted. Downstream from the blowout nozzle there is located a cooling tube provided with several holes for flow of the gas placed on the outlet path of the hot gas generated by the arc. When the hot gas flows in the cooling tube, the gas pressure difference at the level of the outlet holes causes cool gas to be sucked into the tube and gives rise to a mixture of the hot and cold gases. The gas outlet to the outside of the cooling tube is sufficiently cooled to ensure the dielectric characteristics of the circuit breaker.

2 Claims, 2 Drawing Sheets

HIGH-VOLTAGE CIRCUIT BREAKER WITH ARC GAS-BLAST

BACKGROUND OF THE INVENTION

The invention relates to a high-voltage circuit breaker with gas insulation, comprising a stationary arcing contact, a movable arcing contact designed to be coupled to an operating mechanism to be actuated between a closed position and an open position, a piston cylinder gas-blast device associated to a blowout nozzle designed to send a blast of pressurized gas to the breaking gap to blow out the arc drawn between the separated contacts, and means for cooling the hot gas coming from the breaking gap and located downstream from the blowout nozzle in the gas outlet channel enabling the gas to escape to the outside of the circuit breaker, the cooling means comprising a cooling tube acting as support for the stationary arcing contact, said tube being equipped with holes for the hot gas to be cooled by a first heat conduction effect of the tube and by a second effect of mixing with the cold gas.

To interrupt a high intensity current the problem to be solved lies in sweeping the hot gas out of the breaking gap between the circuit breaker contacts. The hot gas generated in the breaking gap when interruption of the current takes place is outlet to the enclosure at earth potential in the case of a metalclad circuit breaker. Expansion of this hot gas in the enclosure is liable to decrease the dielectric strength between the active part of the circuit breaker and the ground/earth, or between the active parts of the circuit breaker phases.

To solve this problem, it has already been proposed to provide a cooling tube in which the hot gas outlet downstream from the breaking gap is cooled by heat conduction effect. The gas removed to the housing is sufficiently cooled for insulation of the metalclad circuit breaker to remain correct.

In the case of a gas-blast circuit breaker, if the compressible volume of the cylinder is large, the blowout pressure generates a large quantity of blowout gas. This results in a significant cooling effect of the gas which enhances the dielectric strength of the circuit breaker. In this case, cooling of the gas by conduction in said cooling tube is secondary, but to the detriment of the dimensions and of the energy required for the gas-blast device.

In the document EP-A-75,668, a circuit breaker comprises a gas-blast device with piston cylinder, and means for cooling the hot gas by heat conduction and by mixing with cold gas. A tube acting as support for the stationary arcing contact comprises holes designed for removal of the cooled gas to the outside of the arc extinguishing chamber. A circuit breaker of this kind requires a large volume of blowout gas provided by the gas-blast device.

The recent circuit breaker development trend towards miniaturization and reduction of the operating energy has led to a decrease of the diameter of the gas-blast cylinder. This results in a more efficient use of the arcing energy increasing the blowout pressure to obtain a better arc blowout effect. The drawback of such a system results from a decrease of the volume of the cold blowout gas affecting the cooling effect of the hot gas. Due to the effect of the hot gas, the dielectric strength in the circuit breaker housing becomes critical even in the presence of the cooling tube downstream from the gas-blast.

SUMMARY OF THE INVENTION

The object of the invention is to improve the dielectric strength of a high-voltage, gas-blast circuit breaker.

The circuit breaker according to the invention is characterized in that the holes of said cooling tube are arranged to allow intake of cold gas to the internal outlet chamber of the circuit breaker, in such a way that the hot gas is cooled by a second effect of mixing with the cold gas flowing through the holes.

At the level of the gas flow holes arranged in the cooling tube, the cool gas at low temperature is sucked towards the inside of the tube through said gas flow holes by the effect of the difference of the internal and external pressures of the tube. The cool gas thus inlet to said cooling tube mixes with the hot gas cooling said hot gas. The gas outlet to the outside of the circuit breaker is sufficiently cooled to re-establish its insulating strength.

According to one feature of the invention, the holes of the cooling tube are arranged near a support component of the stationary main contact, said support component comprising a conducting tube coaxially surrounding the stationary arcing contact. The movable cylinder of the gas-blast device presents an external diameter smaller than the internal diameter of the insulating enclosure on which the conducting tube is fitted.

BRIEF DESCRIPTION OF THE DRAWINGS

Other advantages and features will become more clearly apparent from the following description of an illustrative embodiment of the invention given as a non-restrictive example only, and represented in the accompanying drawings, in which.

DETAILED DESCRIPTION OF THE PREFERRED EMBODIMENT

Figure 1:
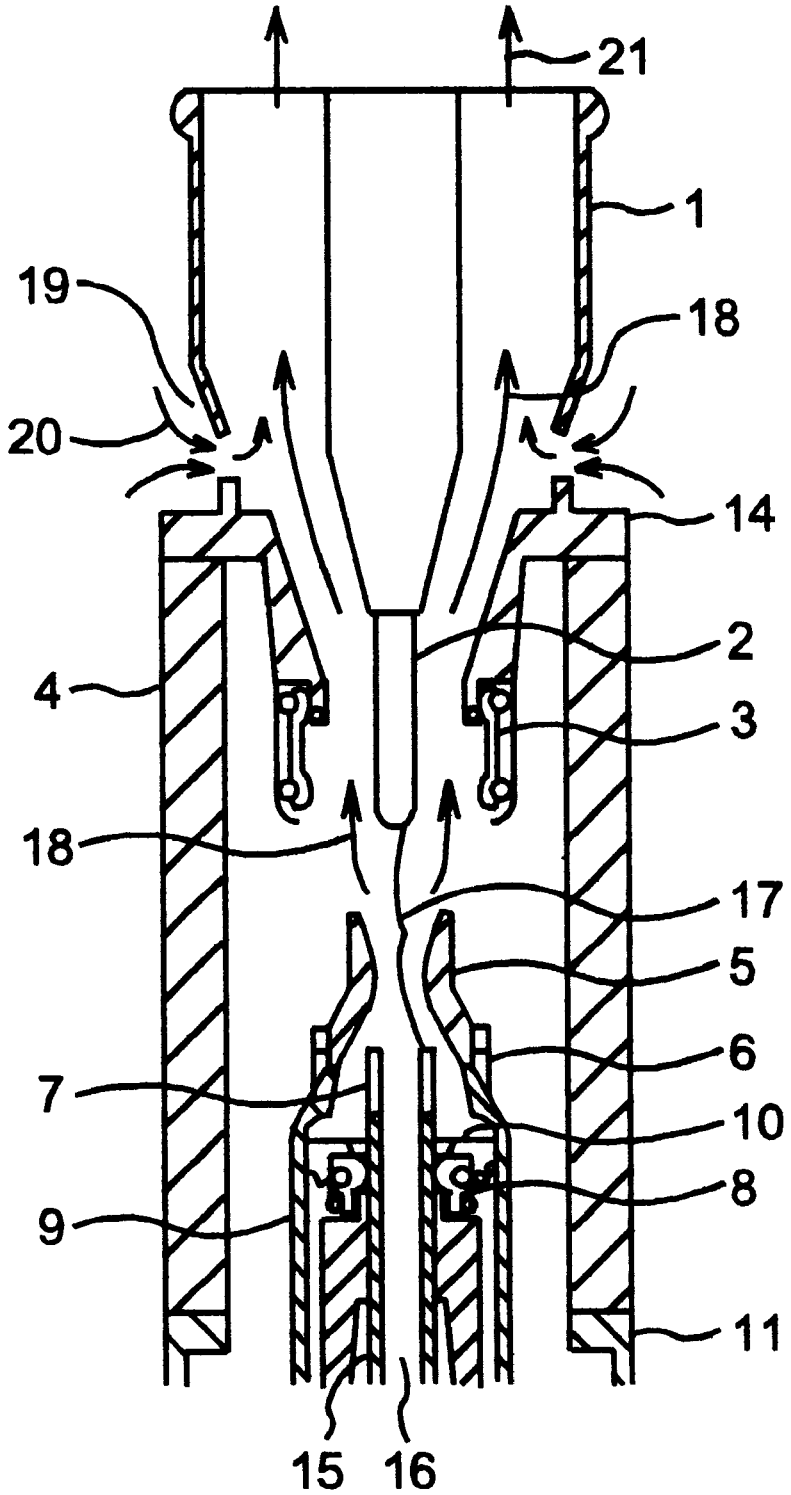
FIG. 1 is a cross-sectional view of the circuit breaker according to the invention in the current breaking phase.
Figure 2:
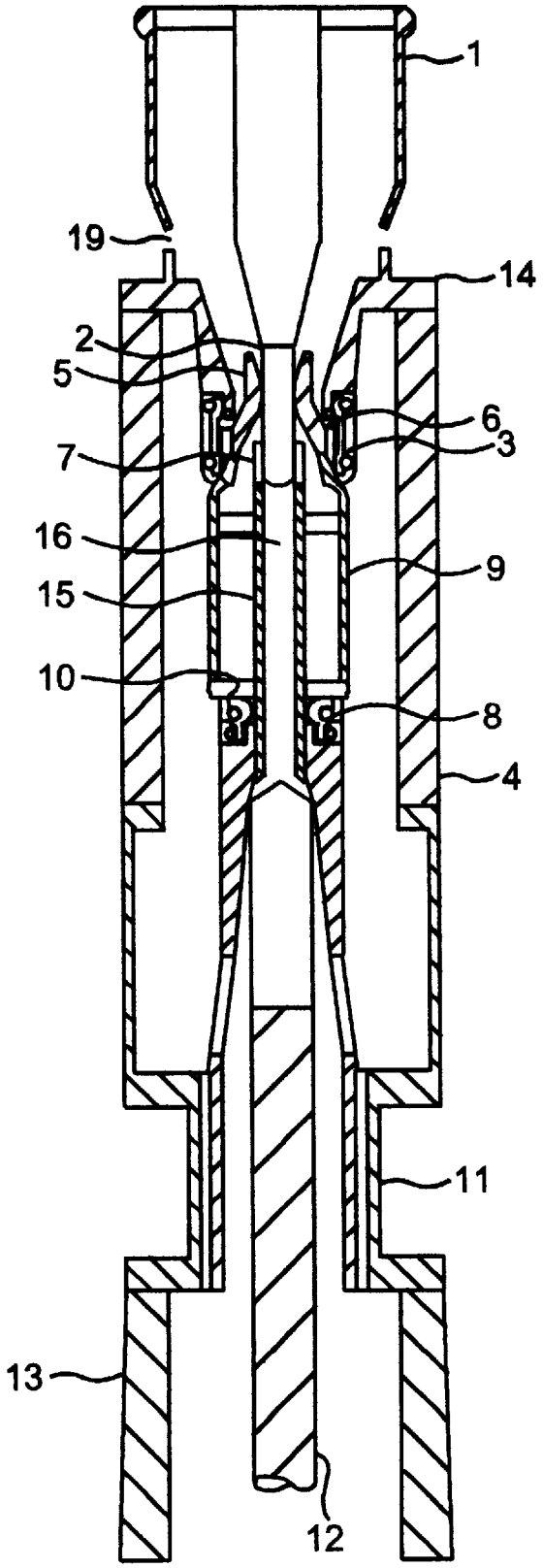
FIG. 2 is an identical view to that of FIG. 1, in the closed position of the circuit breaker.

With reference to FIGS. 1 and 2, a gas circuit breaker, notably sulphur hexafluoride SF6 gas, comprises an upper conducting tube 14 acting as support for the stationary main contact 3 and fitted between a cooling tube 1 and a cylindrical insulating enclosure 4. The cooling tube 1 supports the stationary arcing contact 2 which is arranged coaxially inside the stationary main contact 3. The insulating enclosure 4 is arranged on a lower conducting tube 11 itself supported by a support tube 13 made of insulating material.

An insulating rod 12 is mechanically connected to the operating mechanism (not represented), and is urged upwards when closing of the circuit breaker takes place, and downwards when opening of the circuit breaker takes place. At the end of the insulating rod 12 there is located a movable conducting rod 15 of tubular shape, said rod 15 supporting the movable main contact 6, the movable arcing contact 7 and a gas-blast device comprising a blowout nozzle 5 securedly affixed to the movable main contact 6. The movable conducting rod 15 is provided with an axial hole 16 constituting a gas outlet channel.

The gas-blast device comprises a blowout cylinder 9 extending underneath the nozzle 5 and the movable main contact 6, and able to slide on a fixed piston 10 secured to the lower conducting tube 11. A sliding contact 8 cooperates with the movable conducting rod 15 and provides the electrical connection between the movable contacts 6 and 7 and the lower conducting tube 11.

Holes 19 are provided between the cooling tube 1 and the conducting tube 14.

In the closed position of FIG. 2, the main contacts 6 and 3 are in engagement with one another and ensure that the current flows in the circuit formed by the upper conducting tube 14, the stationary main contact 3, the movable main contact 6, the movable conducting rod 15, the sliding contact 8, and the lower conducting tube 11.

In the current interruption phase, the insulating rod 12 is urged downwards by the mechanism, and causes separation of the main contacts 6 and 3, followed by separation of the arcing contacts 7 and 2. Triggering of an arc between the arcing contacts 7 and 2 takes place at the same time as operation of the gas-blast device.

The downwards movement of the blowout cylinder 9 causes compression of the gas in the compressible space formed between the cylinder 9 and piston 10. The gas thus pressurized escapes via the nozzle 5, and in the opposite direction via the axial hole 16 of the rod 15. The gas outflow through the nozzle 5 is concentrated at the level of the neck of the nozzle 5 and is directed to the arcing zone exerting a blowout effect on the arc 17, followed by outlet of the hot gas 18 generated by the arc to the downstream side of the outlet channel.

The hot gas 18 passes through the cooling tube 1 and is cooled by the heat conduction of the cooling tube 1. At the level of the gas flow holes 19, the gas pressure inside the cooling tube 1 becomes lower than that of the static gas outside the tube 1 following outlet of the hot gas 18. This pressure difference generates an intake of cold gas 20 located outside the tube 1 to the inside of the tube 1 via the holes 19. A mixture of cold gas 20 then takes place with the hot gas 18 inside the cooling tube 1.

The hot gas 18 flowing in the tube 1 is cooled not only by the conduction effect of the tube 1, but also by the mixing effect with the cool gas 20 whose temperature is lower than that of the hot gas 18.

The mixed gas 21 is then expelled to the outside of the circuit breaker ensuring the dielectric characteristics necessary for insulation between phases or for phase-ground insulation.

The cooling effect of the hot gas 18 at the level of the cooling tube 1 is increased even in case of decrease of the blowout gas provided by the gas-blast device. The presence of the holes 19 thus enables the actuating energy for arc blowout to be reduced.

We claim:

1. A high-voltage circuit breaker with gas insulation, comprising:

a stationary main contact and movable main contact;

a stationary arcing contact and a movable arcing contact coupled to an operating mechanism operable between a closed arcing contacts position and an open arcing contacts position;

a piston cylinder gas-blast puffer device comprising a movable cylinder slidably contacting a fixed piston, and a blowout nozzle attached to an inner circumference of said movable cylinder and extending axially from an upper end of said movable cylinder so that said blowout nozzle will direct a blast of pressurized gas towards a breaking gap to blow out an arc between the arcing contacts when separated;

means for cooling gas coming from the breaking gap, said means for cooling comprising a cooling tube acting as a support member for the stationary arcing contact, and being located downstream from the blowout nozzle to form a gas outlet channel for enabling gas to escape to the outside of the circuit breaker, a conductive tube supporting said stationary main contact, and coaxially surrounding the stationary arcing contact to form said gas outlet channel, said conductive tube being fastened to the upper end of a gas filled insulating enclosure, such that said stationary arcing contact is supported independently of said stationary main contact;

holes arranged between said cooling tube and said conductive tube;

said movable cylinder being located within said gas-filled insulating enclosure, and said movable cylinder having an external diameter smaller than an internal diameter of a portion of said conductive tube so that gas coming from the breaking gap will be cooled by a first heat conduction effect of said cooling tube and by a second effect of mixing with cold gas drawn through the holes into the gas outlet channel of said cooling tube.

2. The high-voltage circuit breaker according to claim 1, wherein a potential difference exists between the stationary arcing contact and the stationary main contact during breaking operation.

* * * * *